United States Patent [19]

Hemphill

[11] 4,032,015

[45] June 28, 1977

[54] BUCKET CLEANER AND CONTROL FOR A DIGGING MACHINE

[75] Inventor: Charles Wayne Hemphill, Duncanville, Tex.

[73] Assignee: Adco Company, Dallas, Tex.

[22] Filed: June 23, 1976

[21] Appl. No.: 698,906

[52] U.S. Cl. ..... 214/767; 37/DIG. 2; 214/146 E

[51] Int. Cl.[2] ..... E02F 3/80; E02F 3/85

[58] Field of Search ..... 214/146 E, 510, 767, 214/762; 37/117.5, DIG. 2

[56] References Cited

UNITED STATES PATENTS

| | | | |
|---|---|---|---|
| 3,140,001 | 7/1964 | Strader | 214/767 X |
| 3,484,010 | 12/1969 | Campbell | 214/767 |
| 3,495,728 | 2/1970 | Long | 214/767 X |

FOREIGN PATENTS OR APPLICATIONS

| | | | |
|---|---|---|---|
| 887,841 | 1/1962 | United Kingdom | 214/146 E |

*Primary Examiner*—L. J. Paperner
*Attorney, Agent, or Firm*—Marcus L. Bates

[57] ABSTRACT

A cleaning device for attachment to the dipper stick of a backhoe-type excavator. A blade member is slidably affixed to the pivoted end of the dipper stick and can be retracted clear of the path of travel of the backhoe bucket as the bucket is curled and uncurled. The blade member is extensible into engagement with the bottom of the digging bucket so that as the bucket is uncurled, the end of the blade is progressively extended and follows the irregular bottom surface of the bucket, thereby discharging the contents therefrom.

17 Claims, 11 Drawing Figures

BUCKET CLEANER AND CONTROL FOR A DIGGING MACHINE

BACKGROUND OF THE INVENTION

In the past most trenching excavation was accomplished by the use of trenching machines; however, since the advent of the Federal Occupational Health and Safety Act and its strigent and varying requirements dictating the sides of excavations must be sloped in accordance with the type soil, the trenching machine has become limited in the areas where it may be used. Also, any trenching machine, without extensive modification, is limited to a given size and depth of trench. Muddy terrain and sticky soil conditions prohibit the use of trenching machines in many instances. Therefore, the backhoe with its greater versatility has become the most predominant excavation machine.

The advent of the hydraulic backhoe has opened vast new fields for this machine in all types of construction. Hydraulics enabled designers to build very small to extremely large machines, all very powerful, but compact and manuverable that at comparatively economical prices. Today it seems that everyone moves dirt with backhoes, and most manufacturers of earth moving equipment build backhoes.

A problem that plagues all backhoe users at some time or another, is the dumping or ejecting of material from the bucket when digging in sticky, cohesive material. The hydraulic backhoe provides the means for a comparatively small machine to exert a tremendous force on the bucket. The bucket is constructed long and deep in order to utilize this force. To facilitate easy movement through the cut and to enable the operator to trim the sides of the cut, the bucket is flared in front, that is, the bucket is wider in front than in the back. This feature also speeds the dumping of excavated material.

The asymmetrical, flared design of the bucket is ideal under most conditions and allows a maximum amount of material to be excavated and carried by each cycle of the machine; however, in muddy, sticky conditions it has the opposite effect because the tremendous forces involved compacts the sticky material into the tapered bucket to such a degree that it will not dump out.

This problem accounts for the vast majority of hydraulic and mechanical failures of the machine when digging in muddy and otherwise easy conditions. When this soil condition is encountered and the material does not eject, the operator first attempts to remove the material by shaking the bucket. This is done with the boom fully extended and the bucket in the dump position by moving the control levers rapidly back and forth, thereby creating incalculable pressures and surges in the hydraulic system. These pressures and surges put undue and many times prohibitive stress on the entire hydraulic system, causing failures of hose, valves, pumps, cylinders etc. Rapid movement of the heavy extended load also places great strain and shock on all of the mechanical and structural components of the machine. Failing to eject in this manner, other attempts are made, such as pounding the bucket against the ground, rocks, or other objects. This action not only results in frequent failure to eject the load, but also does expensive damage to the bucket and machine. Extraction of the material by hand using sharpshooters and bars is difficult and time consuming and is usually resorted to only once or twice per day. Normally, under these conditions, the operator will simply continue a dig with a full bucket and the only material excavated is that amount which can be heaped on top of the already packed bucket. This makes the machine work extremely hard and the rate of production is greatly reduced.

In the past there has been a number of attempts to build bucket cleaners, but to date, none appear to have been completely successful. All known approaches to solving this problem have been mechanically actuated with a cleaner bar mounted in and remaining inside the bucket. There are a number of problems associated with this approach and at the present time, results are not satisfactory.

It is therefore desirable to provide an excavating machine which has a bucket cleaning device that can be retracted out of the way of the bucket when it is not in use, and which can be selectively employed whenever sticky material must be ejected from the bucket. It is furthermore desirable that such a device have the capability of being removed from the machine when it is not needed; and furthermore, that provision be made by which the cleaning blade can efficiently follow the irregular contour of the bottom of an ordinary backhoe bucket. Furthermore, it would be desirable to have provide means by which the cleaning blade is automatically extended into contact with the bottom of the bucket, and thereafter automatically retracted away from the bucket.

REFERENCE TO RELATED PATENT APPLICATIONS

Shield, U.S. Pat. No. 2,402,299, proposes a shovel having a curved bottom wall of constant diameter within which there is pivotally positioned a bulkhead. The bulkhead is actuated by a cable which is rove about pulleys in a manner which moves the bulkhead to discharge the contents of the bucket therefrom.

Cunningham, Jr., U.S. Pat. No. 2,885,103, proposes a blade member for a loader bucket whereby the load can be ejected therefrom by the provision of an ejector blade mounted to move along the curve portion of the bucket. The blade is pivotally connected in such a manner that it descends into and wipes out the bucket. The blade of Cunningham, Jr. is affixed to and moves with the bucket.

Perkins et al, U.S. Pat. No. 2,812,872, provides a bucket cleaning apparatus by the provision of an ejector plate 41 pivotally connected to lugs 52 formed on the dipper stick. When the dipper or bucket 35 is pivoted into a dumping position, the ejector plate is held in fixed positional relative to the dipper arm 31 and forcibly ejects material from the bucket.

SUMMARY OF THE INVENTION

Bucket cleaning apparatus for use in conjunction with a digging bucket of a backhoe or the like, wherein the bucket has a bottom which curves with a non-constant radius. The bucket cleaning apparatus includes a blade member which is affixed to a housing. A guide member is provided and is attached to the dipper stick of the backhoe where it slidably receives the housing in such a manner that the housing is slidably captured by the guide member. The guide member is arranged respective to the dipper stick to cause the blade member to be extensible toward the bucket and along a substantially parallel path respective to the dipper stick. The guide member is affixed to a marginal, pivotal end of the dipper stick such that when the blade is retracted, the end of the blade remains adjacent to the dipper stick and clear of the path of travel of the bucket as the bucket is moved from an uncurled into a curled configuration, and sometimes vice versa. When the bucket is in the curled configuration, the blade can be extended into contact with the rearward bottom of the bucket, so that as the bucket is uncurled, the blade remains extended into sliding contact therewith and thereby follows the noncircular bottom thereof and wipes out any material contained therewithin, whereupon the blade is again moved into the retracted configuration so that the bucket is free to be manipulated with no interference from the blade.

Means are included by which the blade can automatically extend into contact with the bottom of the bucket, where the blade bears against the bottom with a constant force to thereby cause the bucket to be wiped clean of adhering excavated material; and thereafter, the blade is automatically moved into the retracted configuration.

The hydraulic control system includes a pair of valves which rearranges the flow pattern to cause the blade to be extended and retracted in conjunction with the normal operation of the bucket. The system includes provisions whereby inadvertent actuation of the blade can result in no harm to the remainder of the apparatus.

Therefore, a primary object of the present invention is the provision of improvements by which an excavator bucket can be wiped clean of excavated material.

Another object of the invention is the provision of apparatus by which an excavating bucket is mechanically cleaned of wet and sticky material.

A further object of this invention is the disclosure and provision of an ejector blade which is automatically extended into an excavating bucket so that as the bucket is uncurled, the contents thereof are discharged.

A still further object of this invention is the provision of an ejection apparatus whereby a loaded, noncircular, excavating bucket has the load automatically ejected therefrom.

Another and still further object of this invention is the disclosure and provision of apparatus for ejecting a load from an excavating bucket in a new and improved manner, by the provision of a blade which utilizes the pivotal movement of the bucket in order to attain a wiping movement.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

The apparatus according to this invention is directed to a bucket cleaning device for attachment to an earth excavating machine such as a backhoe, and hydraulic control circuitry therefor.

Figure 1:
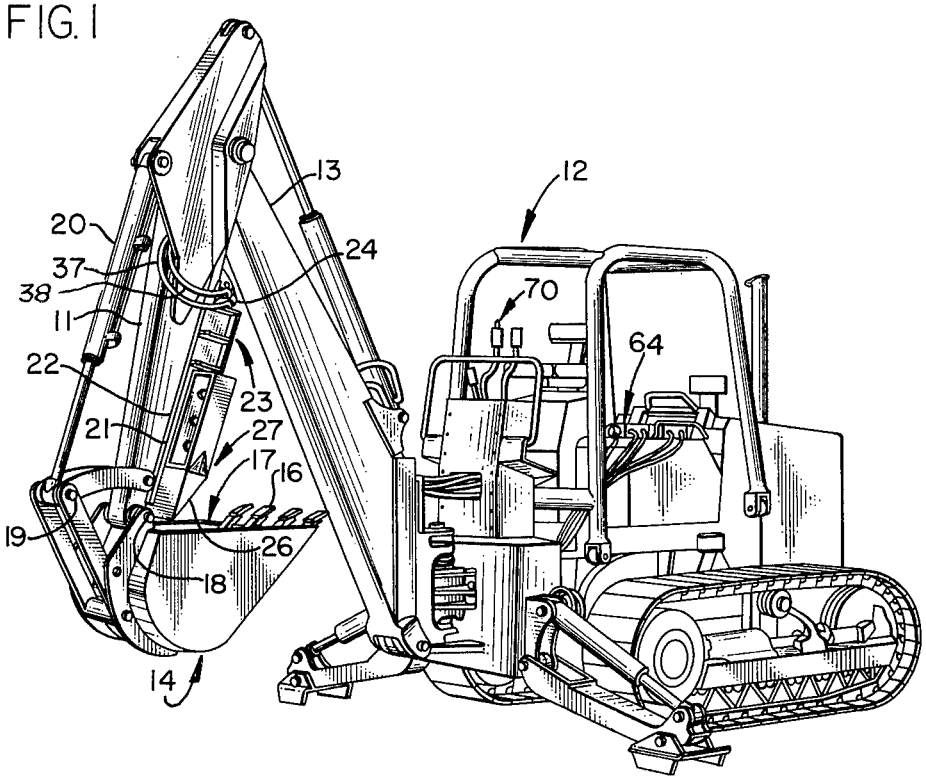
FIG. 1 is a perspective view of an excavating machine having a bucket cleaning apparatus mounted thereon which has been made in accordance with the present invention.
Figure 2:
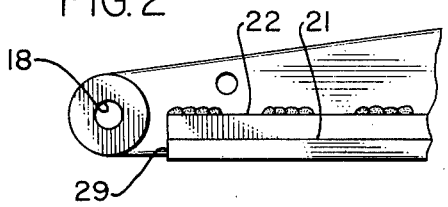
FIG. 2 is an enlarged, fragmentary detail of part of the apparatus disclosed in FIG. 1.
Figure 3:
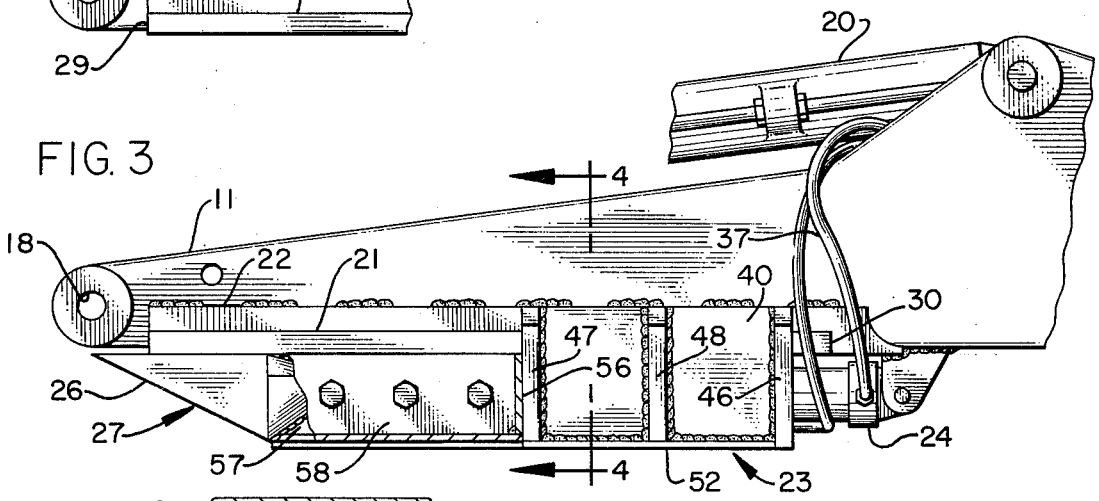
FIG. 3 is an enlarged, fragmentary detail of part of the apparatus disclosed in FIG. 1, with some parts thereof being removed therefrom, and some of the remaining parts being shown in cross section.
Figure 4:
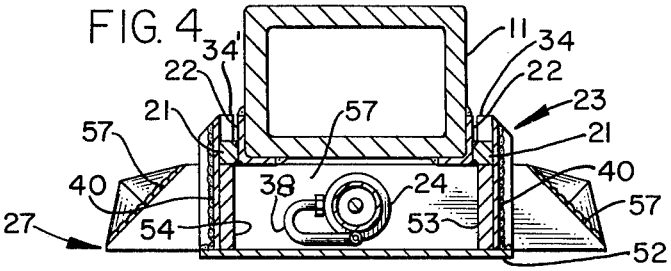
FIG. 4 is a cross-sectional view taken along line 4—4 of FIG. 3.

FIG. 1 discloses an excavating machine made in accordance with the prior art, having apparatus made in accordance with the present invention operatively associated therewith. The apparatus of the present invention can be mounted on any number of different excavating machines other than the specific illustration selected for FIG. 1.

In FIG. 1, a dipper stick 11 is disposed forwardly of a tractor 12, with a boom 13 being supported by the tractor in such a manner that the boom can be horizontally swung in a pivotal manner about the tractor. The dipper stick is of usual construction and has one end thereof journaled to the boom, while a bucket 14 is pivotally suspended adjacent to the free end portion of the dipper stick which is removed from the pivoted end thereof.

Figure 5:
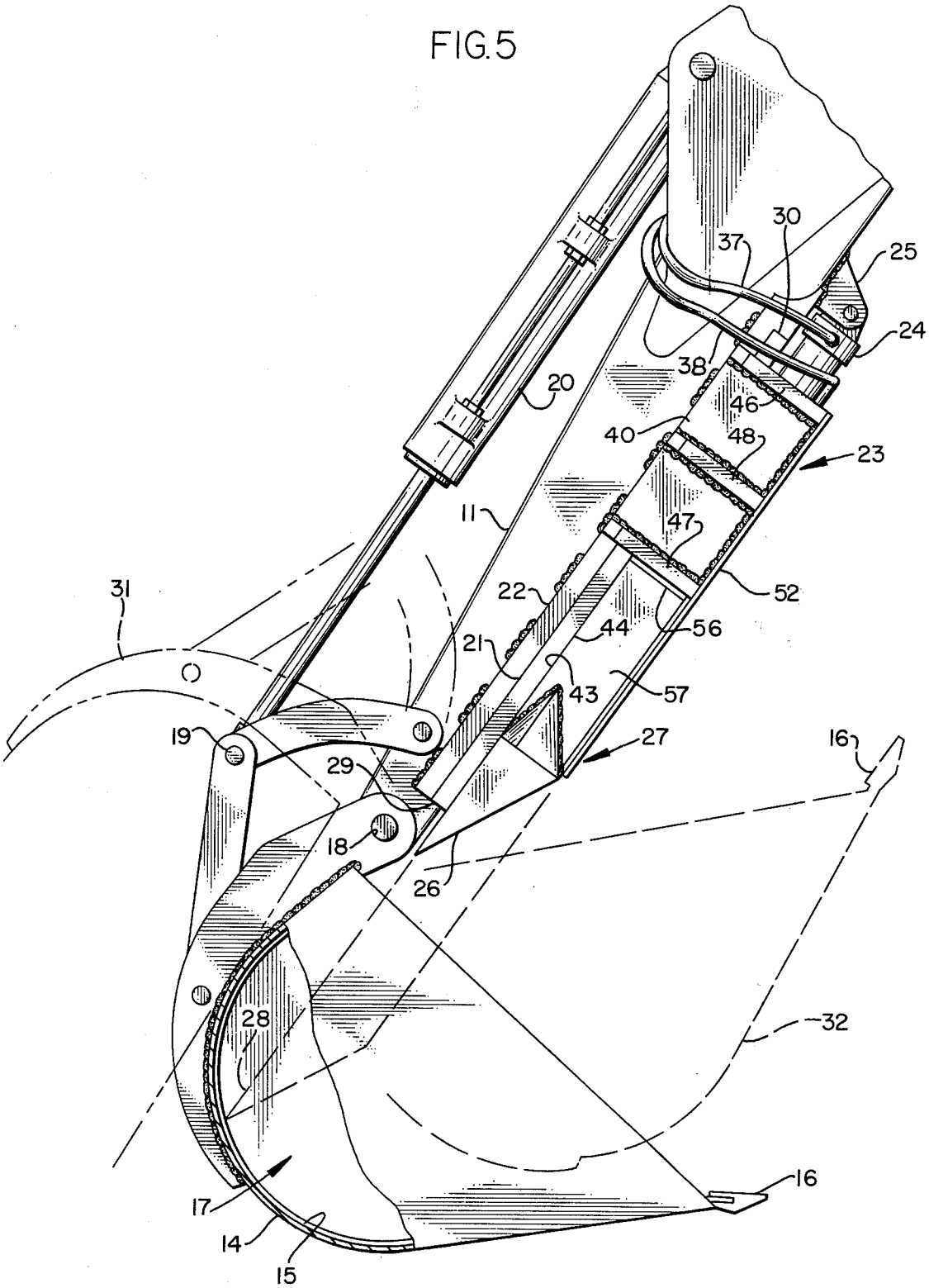
FIG. 5 is an enlarged, fragmentary, side view of part of the apparatus disclosed in FIG. 1.
Figure 6:
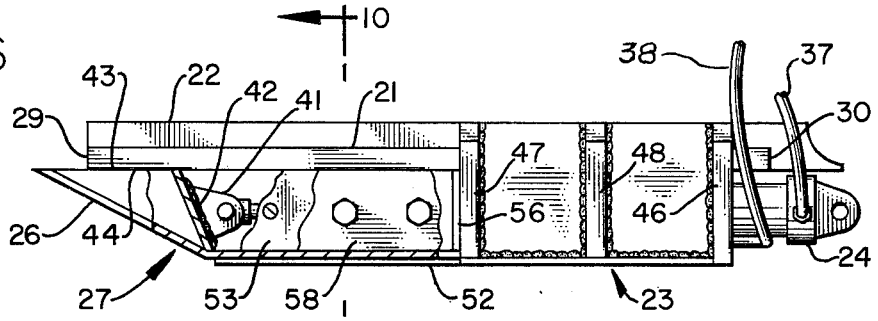
FIG. 6 is a side view of the bucket cleaning apparatus of the present invention, with some parts thereof being broken away therefrom, and some of the remaining parts being shown in cross section.
Figure 7:
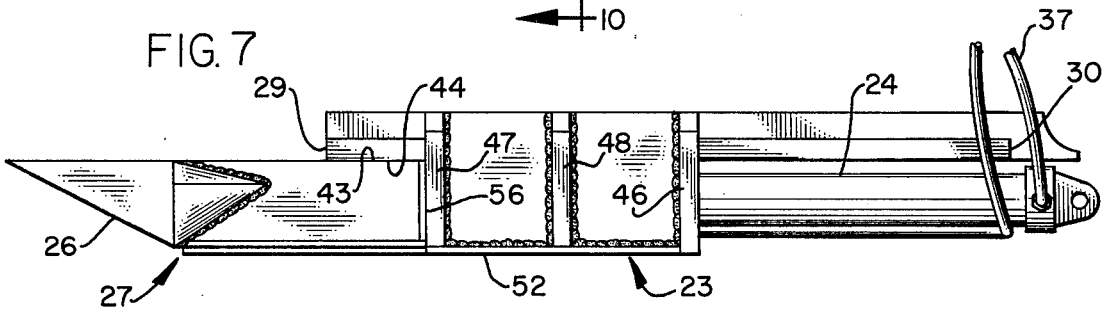
FIG. 7 is similar to FIG. 6, with some parts thereof being shown in an alternate position.

As seen in FIG. 5, in conjunction with FIG. 1, the bottom interior 15 of the bucket is of a nonconstant radius, much like a French curve, for reasons which are appreciated by those skilled in the art. Digging teeth 16 are optionally provided at the forward or digging end of the bucket. The interior 17 of the bucket is of an upwardly opening design in the usual manner of a bucket associated with a backhoe. Bucket pivot 18 enables the bucket to be suspended in journaled relationship from the dipper stick in such a manner to achieve pivotal motion in the vertical plane.

Pivot pin 19 connects the illustrated bucket actuating linkage together, and the opposed end of one of the links is pinned to the dipper stick while the remaining end of the link is pinned to the rearward reinforced webs of the bucket. Hydraulic bucket cylinder 20 unfolds the linkage to thereby curl the bucket, and is retracted to collapse the linkage to thereby uncurl the bucket.

The foregoing exemplifies a conventional excavating machine of the backhoe type.

The invention comprises a guide member 21 which preferably is in the form of two spaced, elongated rails.

The edges of the rails are each weldably attached to an elongated mount 22. In the illustration of FIGS. 2–5, a pair of spaced mounts 22 is seen to be welded to opposed sides of the dipper stick such that the rails are disposed in underlying relationship thereto so that each of the rails are arranged more or less parallel to the underside surface of the dipper stick.

Numeral 31 broadly illustrates a housing which is slidably captured in supported relationship by the rails, and which can be moved longitudinally along the rails in response to actuation thereof by the hydraulic blade cylinder 24. As seen in FIG. 5, a lug 25 is rigidly affixed to the dipper stick at a location remote from each end thereof and pivotally anchors one end of the hydraulic blade cylinder thereto.

Figure 8:
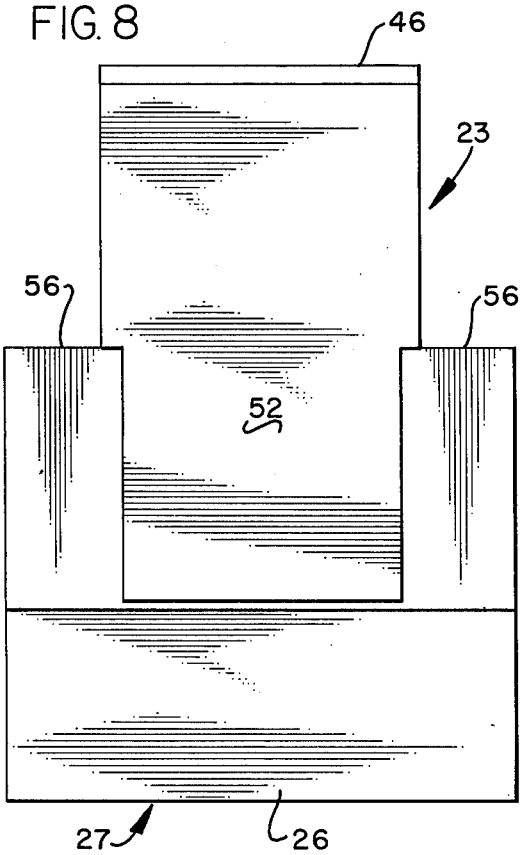
FIG. 8 is a bottom view of part of the apparatus disclosed in FIG. 7.
Figure 9:
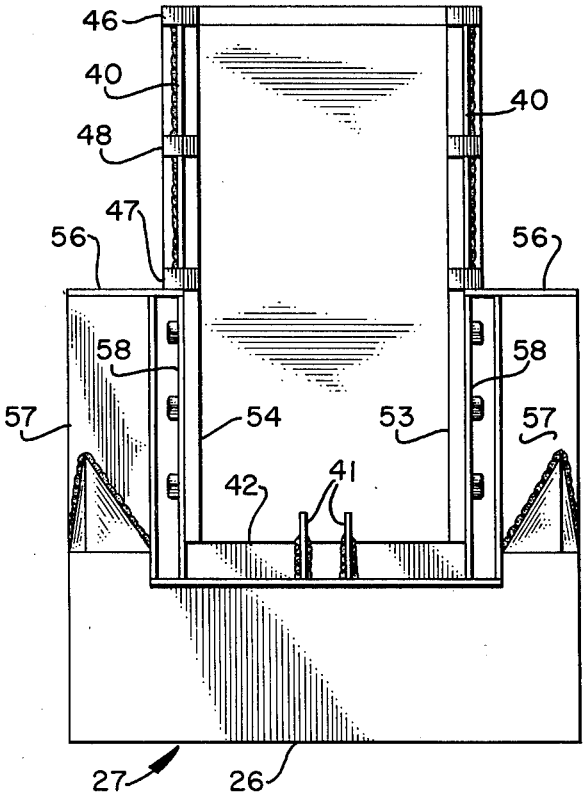
FIG. 9 is a top view of part of the apparatus disclosed in FIG. 7.
Figure 10:
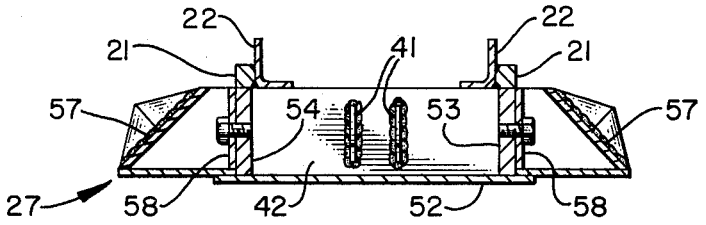
FIG. 10 is a cross-sectional view taken along line 10—10 of FIG. 6.

Sloped end portion 26 of an extensible blade member 27 is attached by the illustration bolts to the housing so that the blade member moves therewith. As best seen in the illustration of FIGS. 8 and 9, in conjunction with FIG. 4, the sloped or forward end 26 of the blade is substantially wider than the slidable housing 23, with the width of the blade essentially extending from sidewall to sidewall of the bucket when the blade is extended into the dot-dash position seen illustrated by numeral 28 in FIG. 5.

Numerals 29 and 30 indicate the opposed terminal ends of one of the rails, while numerals 31 and 32, respectively, illustrate the relative position of the bucket when it is moved into the uncurled and curled configuration, respectively.

Hydraulic hoses 36 are connected to actuate the bucket cylinder 20, while hydraulic hoses 37 are connected to actuate the blade cylinder 24, to thereby provide for a supply and return of hydraulic fluid to each of the double-acting pistons thereof.

As seen in FIGS. 6-9, together with other figures of the drawings, the slidable housing includes spaced, opposed sidewalls 40, each of which are reinforced by a plurality of external vertical members 46, 47, and 48. The sidewalls are tied to a bottom plate member 52, which extends in a forward direction and terminates before the blade portion turns up into the sloped portion 26. Bulkhead 42 forms a lateral reinforcing member for the blade. A pair of lugs 41 are attached to the lateral member. The lugs are attached in journaled relationship to the end of the piston rod of a piston (not shown) contained within the blade cylinder.

Members 53 and 54 are affixed to the opposed sidewalls 40 and hence indirectly to members 46–48. The members are positioned in spaced, parallel relationship respective to the rails or guide member 21. Accordingly, the spaced apart, parallel guide members 21 are located on either side of the dipper stick and each guide member is slidably captured within the longitudinally extending, spaced, parallel groove of the housing, wherein the grooves are formed by the coacting members 34, 40, and 53. The members 34 extend the length of the housing 23 and therefore underlie plate member 40, and essentially ties together the spaced vertical web members 46–48.

Opposed parallel members 53 and 54 therefore slidably engage the underside of the opposed rail members 21 with each of the rail members extending the entire length of the housing such that the load or forces imposed by the blade is transferred into the dipper stick.

Rearwardly disposed end 56 of the blade member abuttingly and removably engages web member 47. The blade member is further provided with opposed, enlarged sides 57 which are tied to the pair of side members 58. As seen illustrated in FIGS. 3, 6, and 9, the side members 58 are bolted into members 53 and 54, thereby enabling blades of different widths to be readily affixed to the housing 23.

As seen illustrated in FIGS. 6-9, the housing can be removed from the rails by disconnecting the hydraulic hoses 37 and removing the pin at lug 25, whereupon the entire apparatus can be slidably moved in a rearward direction until the grooves clear the rails, thereby removing the housing, blade, and cylinder from the dipper stick. Moreover, the mount member 22 can be bolted onto the dipper stick rather than welded, should this expedient be preferred.

Figure 11:
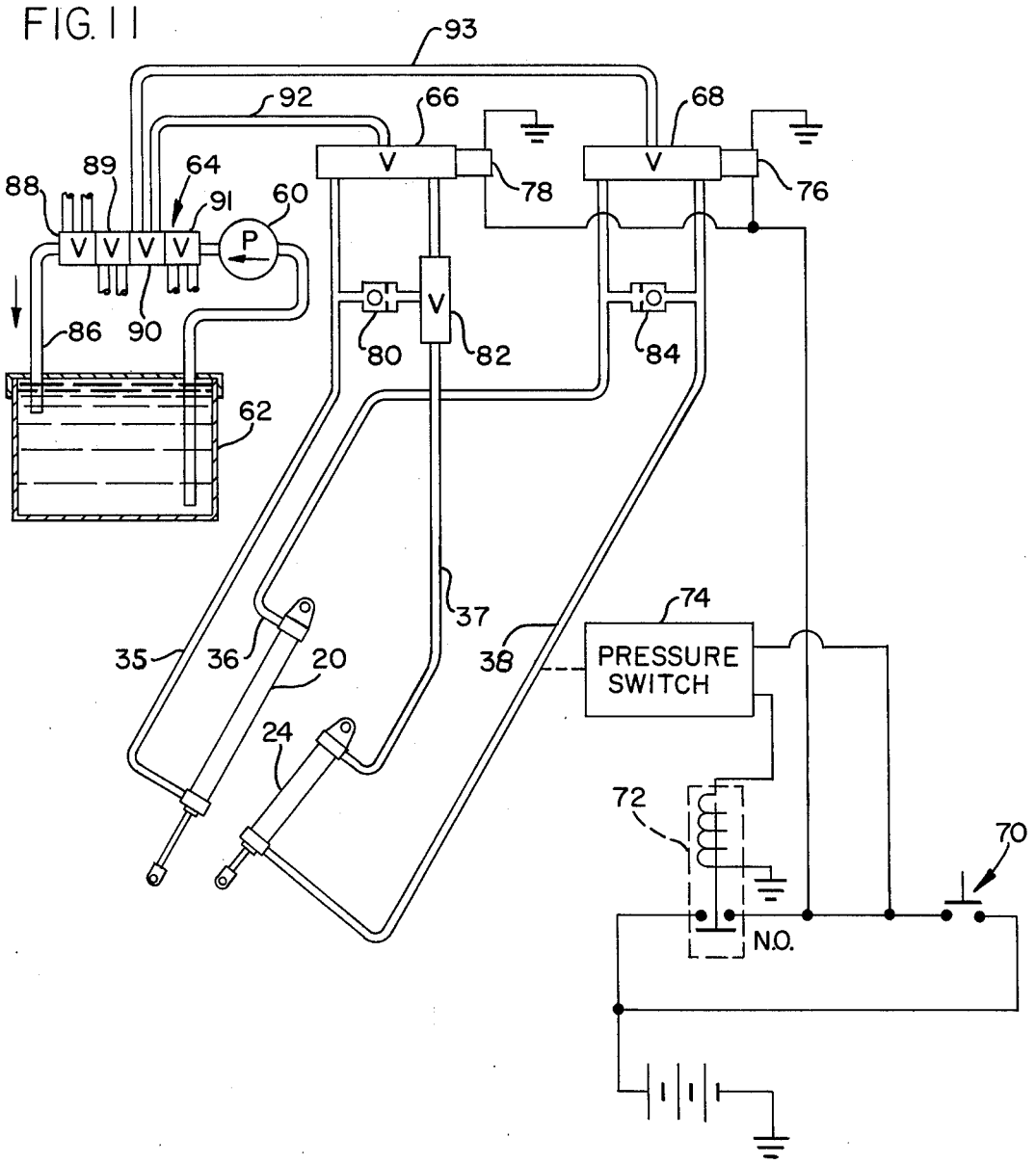
FIG. 11 is a part diagrammatical, part schematical representation of a hydraulic control circuit for use in conjunction with the apparatus disclosed in some of the foregoing figures.

FIG. 11 illustrates a hydraulic and electrical control system by which the action of the blade respective to the bucket is automatically controlled. A hydraulic pump 60 has the suction side thereof flow connected to a reservoir 62, and the pressure side connected to a valve block 64. Valve block 64 provides a controlled supply and return of hydraulic power fluid for the various hydraulic cylinders associated with the digging machine of FIG. 1. Valves 66 and 68 are two-way flow valves which are spring biased onto one position and actuated to the alternate position by means of an electrical solenoid.

Switch 70 energizes a holding relay 72, the normally open contacts of which provide a source of current to the first and second solenoids 76 and 78. Hence, momentary closure of switch 70 causes the normally opened contacts of the solenoid-actuated switch 72 to close, thereby providing a source of current to keep the holding relay 72 closed and to the parallel connected first and second solenoids 76 and 78 of the first and second two-way control valves 66 and 68.

The normally closed contacts of pressure switch 74 are series connected respective to the holding relay coil. The pressure switch contacts are opened when fluid pressure in conduit 38, exceeds a normal value for operation of cylinder 24.

A first check valve 80 is connected between a sequence valve 82 and the hydraulic line 35 leading to the bucket cylinder. The sequence valve causes fluid to flow at 37 until the pressure reaches a preset value, which causes the valve to then divert flow into line 35 by means of check valve 80. Hence, flow commences at 37 and thereafter concurrently at 37 and 35, with the minimum pressure at 37 remaining at a constant value. Check valve 84 is placed between lines 36 and 38 leading from the valve 68 and admits flow from line 36 to line 38.

Fluid returned to the valve 64 is flowed to the reservoir by means of a flow conduit 86. Control valves 88 and 89 are connected to various other hydraulically actuated devices associated with the machine. Valve 90 controls the flow of fluid to and from the two-way valves 66 and 68, while valve 91 provides still other hydraulic systems of the apparatus with a source of pressure. Flow conduit 92 and 93, respectively, are connected to the before mentioned two-way valves 66 and 68, respectively.

In operation of the hydraulic system of FIG. 11, with the pump 60 running to supply a source of fluid to the plurality of valves 64, and with excess fluid being bypassed back to the reservoir 62 in the usual manner, the valve 90 is actuated to one of its alternant positions to cause conduit 92 to be the supply and 93 the return, and vice versa, when the valve 90 is reversed. This action causes fluid to flow through the left side of the two-way valve 66 and directly to conduit 35, thereby retracting the piston of cylinder 20 and causing the bucket to uncurl. At the same time, return flow occurs through conduit 36, through the left side of the two-way valve 68, and to the return line 93. The bucket can now dig into the earth in the usual manner.

Upon control valve 90 being reversed to cause line 93 to become the supply and line 92 the return, hydraulic pressure flow occurs at 93, across the left side of the two-way valve 68, to conduit 36, causing the piston of cylinder 20 to be extended and the bucket curled. Return flow from cylinder 20 is effected along line 35, across the left side of the valve 66, and through conduit 92.

At the same time, pressure flow occurs from line 36, across check valve 84 to line 38 to cause the blade to remain in the retracted position with any return flow from cylinder 24 occurring through line 37, through the check valve 80, where it joins the flow through line 35.

Therefore, when the solenoids 76 and 78 are not energized the apparatus operates in the conventional manner with the additional protection of automatic blade retraction.

On the other hand, assuming that switch 70 has been actuated, causing current to flow to the solenoids 76 and 78 whereupon the two-way valves 66 and 68 are shifted to the alternate position, flow now will occur from line 92, through the right side of the two-way valve 66 and to the sequence valve. The sequence valve first permits flow along conduit 37 to extend the blade until it contacts the bucket, and thereafter shifts to permit concurrent flow through check valve 80 and along conduit 35, thereby causing the bucket to commence to uncurl. As the bucket is uncurled, a constant pressure is maintained on line 37 so that the progressively extending blade continues to remain in contact with the removing curved bottom of the bucket, thereby ejecting the contents thereof.

The valve 90 is next reversed into the position that normally curls the bucket; however, the flow from line 93 into the right side of valve 68 goes to line 38 but cannot enter line 36 due to check valve 84. Therefore, all of the flow goes to line 38 and to cylinder 24, causing the cleaner plate to be rapidly retracted into its uppermost position. When cylinder 24 reaches the end of its travel, the pressure in line 38 increases to actuate the pressure switch. This action prevents the bucket from curling when the cleaner plate is extended.

The hydraulic control system of the present invention is designed such that the cleaner may be actuated at any time with the bucket in any position; however, once actuated, it will automatically control all functions until the cleaner plate is back in the retracted position. Once the cleaner plate is actuated, the cycle can be interrupted at any time by reversing the control lever 90. When this lever is moved to the curl position, the cleaner plate will retract from whatever position it is in.

In operation, as the operator is making his cut and filling the bucket, he decides that he wants to clean the bucket on this trip. At the end of the filling cycle the bucket will be in the curled position. As he hoists the bucket and begins the swing cycle the operator actuates switch 70 which is preferably located on one of the control levers. The switch is pushed with the heel of the hand, therefore, the operator does not have to remove his hand from the control lever nor stop any function. After actuating the switch and during the swing cycle, the operator pushes the bucket uncurl lever. When the switch was actuated the cleaner control valve was shifted into the clean position, therefore, when the bucket uncurl lever is pushed the cleaner plate has to extend down into the bucket before the bucket will uncurl. The cleaner plate extends rapidly and will usually be extended before the bucket is in the dumping position. If this occurs the operator simply releases the curl control lever until the bucket is in position at which time he again pushes the uncurl control lever. Since the cleaner plate is in position, the bucket immediately begins to uncurl, thereby dumping the contents of the bucket with no loss of time. At the end of the dumping cycle the operator begins his swing back to the cut. At this time and during this swing cycle, the operator pulls the curl control lever. The cleaner control valve is still in the clean position, therefore, when the curl lever is pulled, the bucket will not curl until the cleaner plate has retracted into the up position. The cleaner plate retracts rapidly and will usually be retracted before the swing cycle is completed. When the cleaner plate has retracted to the up position, the cleaner control valve will automatically shift back to the normal operating position allowing the bucket to curl. If the bucket is not yet in the digging position, the operator simply releases the bucket curl control lever until he is ready to dig. The bucket cleaner will not work a second time until the control button is again actuated.

An important feature of the bucket cleaner of this invention is the capability to clean the bucket at the operator's discretion, and at all other times to remain inoperative so as to not hinder the normal operation of the machine. The cleaner does not interfere or slow down the operation of the machine or its operator because the cleaning operation is sandwiched inbetween normal functions. In order to accomplish this the cleaner control valve is electrically controlled with a button mounted on one of the existing control levers in such a way that the operator, without removing his hand from the control lever, pushes this switch or button, with the heel of his hand. After this switch is pushed one time the control valve, in conjunction with the curl cylinder control lever, automatically performs all of the cleaning functions, returns the cleaner to the raised position, and returns the system to normal operating configuration. The cleaner will not work again until the control switch is pushed again.

The cleaner control valve automatically sequences all operations of the cleaner so as to prevent the operator from damaging the unit, such as, for example, closing the bucket with the cleaner in the extended position.

With the cleaner plate in the retracted position, the cleaner control valve will be in the normal open position, that is, oil will flow freely back and forth to the curl cylinder as dictated by the operator.

Normally, when the cleaner control valve switch 70 is pushed, the bucket will be in the closed or curled position. When the button, or switch, is pushed, the control valve shifts, but nothing happens until the bucket curl control lever is actuated. Normally, when this lever is pushed, the oil goes to the bottom side of the curl cylinder causing the bucket to uncurl. However, with the cleaner control valve in the cleaning position, all oil is diverted to the cleaner plate cylinder until a predetermined pressure is reached (approximately 750 pounds). This pressure causes the cleaner cylinder to force the cleaner plate down into the bucket until it reaches the bottom at which time the pressure will further increase and all oil over the predetermined pressure will go to the curl cylinder causing the bucket to open, or uncurl. This arrangement maintains a constant pressure on the cleaner cylinder, causing the cleaner plate to extend and continue to extend into contact with the bottom of the bucket as it is uncurled, thereby scraping the bottom of the bucket through the complete uncurling cycle and ejecting all the contents of the bucket. At the end of the uncurling cycle, both curl cylinder and cleaner cylinder will be at the end of their stroke, and should the curl control lever be held in this position, all oil will be by-passed by the system relief control valve, the same as if the cleaner was not on the machine.

When the operator desires to curl the bucket he pulls the curl control lever back, the cleaner control valve is still in the clean position, therefore, all oil is diverted to the retract side of the cleaner plate cylinder, allowing no oil to go to the curl cylinder but causing the cleaner plate to move into the retracted position. At such time, the cleaner control valve will automatically shift back to the normal open position allowing the curl cylinder to operate.

The cleaner control valve switch may be pushed at any time without causing any harm, regardless of what the operator does with the curl control lever. At no time can the bucket be curled with the cleaner plate down.

The entire bucket cleaning unit and its operation is designed not to interfere with nor slow down the normal operation of the machine. It does not require operator skill since the automatic cleaner control valve properly sequenceses all operations. The extending and retracting of the cleaner plate is accomplished during the period of cycling when the bucket is not being used.

The blade, along with the housing, can readily be removed from the dipper stick by merely pulling the pin which joins the blade cylinder to the lugs 25, removing the hydraulic hoses 37 and 38, and sliding the housing in a direction away from the bucket until the housing is freed from the spaced rails.

Should a bucket of different dimensions be required for installation onto the backhoe of FIG. 1, a blade of different width can be attached to the housing by removing the bolts illustrated in FIG. 9 and replacing the blade portion 27 with one of a different and more suitable size.

It is contemplated that the electrical circuitry of FIG. 11 can be replaced with pneumatic or hydraulic circuitry where such an expedient is considered to be desirable.

The two-way valves 76 and 78 can be any commercially available solenoid actuated valve which form the two indicated flow paths when moved between the two alternate flow positions.

The sequence valve 82 can be a pressure relief valve which provides a first regulated pressure for the blade cylinder and which bypasses the remainder of the flow to the bucket cylinder. One suitable valve is manufactured by: DOUBLE A, Model BT10, available from Womack Machinery and Supply, Dallas, Texas.

I claim:

1. In a digging machine having a main frame, a boom supported by the main frame, a dipper stick pivotally mounted to said boom, a digging bucket pivotally suspended adjacent an end portion of the dipper stick remote from the pivoted end thereof, means by which said dipper stick is pivoted in an arc about its pivotal connection, and means by which the bucket is vertically pivoted in an arc about its pivotal connection from a curled onto an uncurled discharging position; the bucket having a rear wall, opposed sidewalls, and a curved bottom wall connecting the rear and side walls together to leave a digging end spaced from the rear wall; the improvement comprising:

a bucket cleaning apparatus comprised of a blade member, a housing; a guide member; means by which said blade member is affixed to said housing, means slidably capturing said housing to said guide member such that the housing can slidably move longitudinally in captured relationship respective to said guide member;

means by which said guide member is affixed to a marginal end of the dipper stick in spaced relationship respective to the bucket journal and to the dipper stick journal, so that when the bucket is curled, said blade member is aligned with the interior of the bucket and placed in close proximity of the rear wall of the bucket;

means by which said housing can be moved along said guide member towards and away from said bucket such that said blade member is extended into engagement with the bottom of the bucket with a progressive movement so that the blade contacts the bottom of the bucket as the bucket is uncurled, thereby causing the bucket to scrape against the blade and the blade to discharge the contents of the bucket.

2. The improvement of claim 1 wherein said guide means is affixed to opposed sides of the dipper stick, said housing includes a batlam wall and spaced walls which upwardly extend from said bottom wall, and means formed on the interior outer marginal edges of each said spaced wall of said housing for slidably engaging said guide means; so that said housing can be slidably moved towards said bucket to cause the terminal end of said blade to engage the bottom of the bucket, and, said housing can be slidably moved in a direction away from the bucket until the blade is removed from the interior of the bucket.

3. The improvement of claim 1 wherein the bucket is moved between a curled and an uncurled configuration by a double-acting hydraulic bucket cylinder;

said housing is slidably extended and retracted by a double-acting hydraulic blade cylinder;

a hydraulic control system for said bucket cylinder and said blade cylinder comprising:

a first and second two-way flow valve, a supply and a return line for flow of hydraulic fluid to and from said first and second two-way flow valves, said bucket cylinder having a double-acting piston for actuating the bucket from a curled into an uncurled configuration, said blade cylinder having a double-acting piston for actuating the blade from an extended into a retracted position, a sequence valve means, and a first and second check valve means;

a first flow line connecting said first flow valve to one side of said bucket cylinder, a second flow line connecting said second flow valve to the remaining side of said bucket cylinder, a third flow line connecting one side of said blade cylinder to said first flow valve, said sequence valve being series connected in said third flow line, a fourth flow line connecting said second flow valve to the remaining side of said blade cylinder;

said first check valve being connected to permit flow from said sequence valve to said first flow line, said second check valve being connected to permit flow from said second flow line to said fourth flow line;

and means by which said first and second flow valves are shifted between alternate positions such that said first and third flow lines, respectively, are connected to said supply and return respectively, and said second and fourth lines, respectively, are connected to said supply and return, respectively, when the flow valves are moved to the alternate positions.

4. The improvement of claim 1 and further including a source of electrical current, a normally opened switch, a holding relay, a normally closed pressure actuated switch, and a first and second solenoid, respectively, connected to shift said first and second two-way valves, respectively, to the alternate position;

means by which said holding relay is connected to said source of current and to said first and second solenoids; means by which said normally opened switch is connected to actuate said holding relay to the current conducting position, means by which said pressure actuated switch is connected to interrupt current flow through said holding relay when the hydraulic pressure within said blade cylinder exceeds a maximum set value;

so that when said normally spaced opened switch is closed, said holding relay is energized, whereupon said first and second solenoids are then energized until said pressure actuated switch is moved to the open configuration.

5. The improvement of claim 1 wherein said guide means is comprised of two spaced rails which are affixed to opposed sides of the dipper stick at a location which causes the blade to contact the bottom of the bucket in close proximity of the rear wall thereof, and to enable the blade to be retracted clear of the bucket;

said housing is comprised of spaced walls joined together by a lateral member, a groove formed on the interior of each said spaced wall for slidably receiving said rail therein, said blade being affixed to and extending away from said housing such that sliding movement of said housing relative to said rails provide for the extension and retracting of said blade respective to the bucket.

6. The improvement of claim 1 wherein said guide means is comprised of two rails which are affixed to opposed sides of the dipper stick at a location which causes the blade to contact the bottom of the bucket in close proximity of the rear wall thereof, and to enable the blade to be retracted clear of the bucket;

said housing comprising spaced walls joined together by a lateral member, a groove formed on the interior of each said spaced wall for slidably receiving said rail therein, said blade being affixed to and extending away from said housing such that sliding movement of said housing relative to said rails provide for the extension and retraction of said blade respective to the bucket;

and further including a source of electrical current, a normally opened switch, a holding relay, a normally closed pressure actuated switch, and a first and second solenoid, respectively, connected to shift said first and second two-way valves, respectively, to be alternate position;

circuit means by which said holding relay is connected to said source of current and to said first and second solenoids; circuit means by which said normally opened switch is connected to actuate said holding relay to the current conducting position, means by which said pressure actuated switch is connected to interrupt current flow through said holding relay when the hydraulic pressure within said blade cylinder exceeds a maximum set value;

so that when said normally opened switch is closed, said holding relay is energized, whereupon said first and second solenoids are then energized until said pressure actuated switch is moved to the open configuration.

7. The improvement of claim 1 wherein said guide means is affixed to opposed sides of the dipper stick, said housing includes a bottom wall and spaced walls which upwardly extend from said bottom wall, and means formed on the interior outer marginal edges of each said spaced wall of said housing for slidably engaging said guide means;

so that said housing can be slidably moved towards said bucket to cause the terminal end of said blade to engage the bottom of the bucket, and, said housing can be slidably moved in a direction away from the bucket until the blade is removed from the interior of the bucket;

the bucket is moved between a curled and an uncurled configuration by a double-acting hydraulic bucket cylinder;

said housing is slidably extended and retracted by a double-acting hydraulic blade cylinder;

a hydraulic control system for said bucket cylinder and said blade cylinder comprising:

a first and second two-way flow valve, a supply and a return line for flow of hydraulic fluid to and from said first and second two-way flow valves, said bucket cylinder having a double acting piston for actuating the bucket from a curled into an uncurled configuration, said blade cylinder having a double acting piston for actuating the blade from an extended into a retracted position, a sequence valve means, and first and second check valve means;

a first flow line connecting said first flow valve to one side of said bucket cylinder, a second flow line connecting said second flow valve to the remaining side of said bucket cylinder, a third flow line connecting one side of said blade cylinder to said first flow valve, said sequence valve being series connected in said third flow line, a fourth flow line connecting said second flow valve to the remaining side of said blade cylinder;

said first check valve being connected to permit flow from said sequence valve to said first flow line, said second check valve being connected to permit flow from said second flow line to said fourth flow line;

and means by which said first and second flow valves are shifted between alternate positions such that said first and third flow lines are connected to said supply and return, and said second and fourth lines are connected to said supply and return when the flow valves are moved to the alternate positions.

8. In a backhoe type digging machine having a dipper stick to which there is pivotally mounted a bucket, and having means by which the bucket is moved from an uncurled into a curled configuration;

with the bucket having opposed side walls, and a curved bottom wall connecting the side walls together and forming a rear wall to leave a digging end spaced from the rear wall, the improvement comprising:

a bucket cleaning apparatus comprised of a blade manner; a housing; a guide member; means by which said blade member is affixed to said housing, means slidably capturing said housing to said guide member such that said housing can slidably move in captured relationship respective to said guide member;

means by which said guide member is affixed to a marginal length of said dipper stick in spaced relationship respective to the connection by which the bucket and dipper stick are pivotally joined;

means by which said housing is moved along said guide member towards and away from said bucket such that said blade member can be extended into engagement with the bottom of the bucket with a progressive movement to cause the free end of the blade to contact the bottom of the bucket as the bucket is moved from a curled into an uncurled position; thereby discharging the contents of the bucket.

9. The improvement of claim 8 wherein said guide means is affixed to opposed sides of the dipper stick, said housing includes a bottom wall and spaced walls which upwardly extend from said bottom wall, and means formed on the interior outer marginal edges of each said spaced wall of said housing for slidably engaging said guide means;

so that said housing can be slidably moved towards said bucket to cause the terminal end of said blade to engage the bottom of the bucket, and, said housing can be slidably moved in a direction away from the bucket until the blade is removed from the interior of the bucket.

10. The improvement of claim 8 wherein the bucket is moved between a curled and an uncurled configuration by a double-acting hydraulic bucket cylinder;

said housing is slidably extended and retracted by a double-acting hydraulic blade cylinder;

a hydraulic control system for said bucket cylinder and said blade cylinder comprising:

a first and second two-way flow valve, a supply and a return line for flow of hydraulic fluid to and from said first and second two-way flow valves, said bucket cylinder having a double acting piston for actuating the bucket from a curled into an uncurled configuration, said blade cylinder having a double acting piston for actuating the blade from an extended into a retracted position, a sequence valve means, and a first and second check valve means;

a first flow line connecting said first flow valve to one side of said bucket cylinder, a second flow line connecting said second flow valve to the remaining side of said bucket cylinder, a third flow line connecting one side of said blade cylinder to said first flow valve, said sequence valve being series connected in said third flow line, a fourth flow line connecting said second flow valve to the remaining side of said blade cylinder;

said first check valve being connected to permit flow from said sequence valve to said first flow line, said second check valve being connected to permit flow from said second flow line to said fourth flow line;

and means by which said first and second flow valves are shifted between alternate positions such that said first and third flow lines, respectively, are connected to said supply and return, respectively, and said second and fourth lines, respectively, are connected to said supply and return, respectively, when the flow valves are moved to the alternate positions.

11. The improvement of claim 10 wherein there is further included a source of electrical current, a normally opened switch, a holding relay, a normally closed pressure actuated switch, and a first and second solenoid, respectively, connected to shift said first and second two-way valves, respectively, to the alternate position;

means by which said holding relay is connected to said source of current and to said first and second solenoids; means by which said normally opened switch is connected to actuate said holding relay to the current conducting position, means by which said pressure actuated switch is connected to interrupt current flow through said holding relay when the hydraulic pressure within said blade cylinder exceeds a maximum set value;

so that when said normally opened switch is closed, said holding relay is energized, whereupon said first and second solenoids are then energized until said pressure actuated switch is moved to the open configuration.

12. The improvement of claim 8 wherein said guide means is comprised of two spaced rails which are affixed to opposed sides of the dipper stick at a location which causes the blade to contact the bottom of the bucket in close proximity of the rear wall thereof, and to enable the blade to be retracted clear of the bucket;

said housing is comprised of spaced walls joined together by a lateral member, a groove formed on the interior of each said spaced wall for slidably receiving said rail therein, said blade being affixed to and extending away from said housing such that sliding movement of said housing relative to said rails provide for the extension and retraction of said blade respective to the bucket.

13. The improvement of claim 8 wherein said means by which said housing is moved includes a blade cylinder having a double-acting piston therein, means by which said piston is moved to extend said blade in response to said bucket being uncurled, and means by which said piston is moved to retract said blade in response to said blade reaching the fully extended position.

14. The improvement of claim 8 wherein said guide means is affixed to opposed sides of the dipper stick, said housing includes spaced walls which upwardly extend from a bottom wall, and means formed on the interior outer marginal edges of each said spaced wall of said housing for slidably engaging said guide means;

so that said housing can be slidably moved towards said bucket to cause the terminal end of said blade to engage the bottom of the bucket, and, said housing can be slidably moved in a direction away from the bucket until the blade is removed from the interior of the bucket;

the bucket is moved between a curled and an uncurled configuration by a double-acting hydraulic bucket cylinder;

said housing is slidably extended and retracted by a double-acting hydraulic blade cylinder;

a hydraulic control system for said bucket cylinder and said blade cylinder comprising:

a first and second two-way flow valve, a supply and a return line for flow for hydraulic fluid to and from said first and second two-way flow valves, said bucket cylinder having a double acting piston for actuating the bucket from a curled into an uncurled configuration, said blade cylinder having a double-acting piston for actuating the blade from an extended into a retracted position, a sequence valve means, and first and second check valve means;

a first flow line connecting said first flow valve to one side of said bucket cylinder, a second flow line connecting said second flow valve to the remaining side of said bucket cylinder, a third flow line connecting one side of said blade cylinder to said first flow valve, said sequence valve being series connected in said third flow line, a fourth flow line connecting said second flow valve to the remaining side of said blade cylinder;

said first check valve being connected to permit flow from said sequence valve to said flow line, said second check valve being connected to permit flow from said second flow line to said fourth flow line;

and means by which said first and second flow valves are shifted between alternate positions such that said first and third flow lines are connected to said supply and return, and said second and fourth lines are connected to said supply and return when the flow valves are moved to the alternate positions.

15. A hydraulic control system for a bucket cleaning apparatus comprising:

a first and second two-way flow valve, a supply and a return line for flow of hydraulic fluid to and from said first and second two-way flow valves, a bucket cylinder having a double acting piston for actuating a bucket from a curled into an uncurled configuration, a blade cylinder having a double-acting piston for actuating a blade from an extended into a retracted position, a sequence valve means, and a first and second check valve means, a first flow line connecting said first flow valve to one side of said bucket cylinder, a second flow line connecting said second flow valve to the remaining side of said bucket cylinder, a third flow line connecting one side of said blade cylinder to said first flow valve, said sequence valve being series connected in said third flow line, a fourth flow line connecting said second flow valve to the remaining side of said blade cylinder;

said first check valve being connecting to permit flow from said sequence valve to said first flow line, said second check valve being connected to permit flow from said second flow line to said fourth flow line;

and means by which said first and second flow valves are shifted between alternate positions such that said first and third flow lines, respectively, are connected to said supply and return, respectively, and said second and fourth lines, respectively, are connected to said supply and return, respectively, when the flow valves are moved to the alternate positions.

16. The control system of claim 15 wherein said first and second control valves include a first and second solenoid by which said valves are moved into the alternate flow position;

a source of current, a holding relay, a starting switch means, said first and second solenoids being parallel connected respective to one another and connected to said source of current by said holding relay, and means for de-energizing said holding relay to thereby de-energize said solenoids.

17. The control system of claim 16 wherein said means for de-energizing said holding relay further includes means responsive to movement of said piston blade to its fully extended position.

* * * * *

UNITED STATES PATENT OFFICE

CERTIFICATE OF CORRECTION

PATENT NO. : 4,032,015

DATED : JUNE 28, 1977

INVENTOR(S) : CHARLES WAYNE HEMPHILL

It is certified that error appears in the above-identified patent and that said Letters Patent are hereby corrected as shown below:

Column 1, line 23, "that" should read --and--.

Column 2, line 26, "provide" should read --provided--.

Column 5, line 8, "31" should read --23--.

Column 5, line 17, "illustration" should read --illustrated--.

Column 10, line 7, "onto" should read --into--.

Column 10, line 37, "batlam" should read --bottom--.

Column 11, line 33, cancel "spaced".

Column 11, line 53, insert --spaced-- after "two".

Column 12, line 3, "be" should read --the--.

Column 15, line 6, "for" should read --of--.

Column 15, line 25, insert --first-- after "said", second occurrence.

Column 16, line 14, "connecting" should read --connected--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*